United States Patent [19]

Lang

[11] 4,047,474

[45] Sept. 13, 1977

[54] APPARATUS FOR SEPARATING AND STACKING BLANKS OF A DIE CUT SHEET

[75] Inventor: Pierre Lang, Ecublens, Switzerland

[73] Assignee: J. Bobst & Fils S.A., Switzerland

[21] Appl. No.: 612,572

[22] Filed: Sept. 11, 1975

[30] Foreign Application Priority Data

Oct. 2, 1974 Switzerland ..... 013249/74

[51] Int. Cl.[2] ..... B31B 1/12; B31B 1/98

[52] U.S. Cl. ..... 93/36 A; 93/93 R; 271/197

[58] Field of Search ..... 225/96, 100; 93/36 A, 93/36 R, 59 ES, 93 R; 271/196, 197

[56] References Cited

U.S. PATENT DOCUMENTS

| | | | |
|---|---|---|---|
| 3,583,614 | 6/1971 | Foster, Jr. | 93/36 A X |
| 3,698,708 | 10/1972 | Brawn | 271/197 X |
| 3,774,906 | 11/1973 | Fagan et al. | 271/197 X |
| 3,820,779 | 6/1974 | Bishop | 271/197 X |
| 3,870,213 | 3/1975 | Meylan | 225/100 |
| 3,918,586 | 11/1975 | Tyler et al. | 271/197 X |

*Primary Examiner*—James F. Coan

*Attorney, Agent, or Firm*—Hill, Gross, Simpson, Van Santen, Steadman, Chiara & Simpson

[57] ABSTRACT

An apparatus for separating a plurality of interconnected blanks formed in a sheet and for stacking the separate blanks in a plurality of designated stacks characterized by an input carrier receiving a sheet such as from a delivery end of a die cutting platen press and transports it to a separating unit which separates the interconnected blanks from each other and forms a flow having spaced rows of spaced blanks with the position and sequence of the blanks in the flow being the same as their position and sequence in the sheet. The stacking unit receives the flow and utilizes a suction unit for each of the rows in the flow which unit preferably comprises a belt of pervious material moving along a suction chamber to engage an upper surface of the blanks and transports the engaged blanks to a position above their respective designated stacks. At a position above the designated stacks, peeling devices such as lever arms cause the peeling of the blank from the suction unit to be deposited in a stack on a stack supporting member which is preferably mounted by an elevator structure to enable lowering the support to facilitate removal of the stacks formed thereon.

9 Claims, 7 Drawing Figures

APPARATUS FOR SEPARATING AND STACKING BLANKS OF A DIE CUT SHEET

BACKGROUND OF THE DISCLOSURE

1. Field of the Invention

The present invention relates to a device for separating and stacking blanks such as box blanks and more particularly to a device which is adapted to receive sheets containing a plurality of interconnected blanks which are received from a platen press and to separate the interconnected blanks and stack them in predetermined or designated stacks.

2. Prior Art

The platen presses which have been used in the past to produce box blanks or carton blanks have been of two general types. The first type uses individual sheets for each of the blanks to be produced and the output of this type of press consists of individual blanks which may be conveniently formed into a stack. The second type of press simultaneously produces a plurality of interconnected blanks in a sheet which may be preprinted with the printed matter for each of the cartons or boxes. The press processes the sheet to remove the scrap and waste material and the output of the press consists of a sheet formed of a plurality of interconnected box blanks which are free from scrap and the waste material. These sheets may be stacked individually, but it is thereafter necessary to separate the individual blanks before they can be arranged into individual stacks for later handling or processing.

While the first type of machine produces a single stack of individual box blanks, it is relatively slow in terms of output per unit time. The second type of machine has a faster output but the manual labor required to separate the interconnected blanks is a drawback which detracts from its efficiency. For example, a stack of the sheets having interconnected blanks are manually separated by using either air chisels or hammers and chisels. Such manual operations are extremely noisy and are expensive due to the labor cost involved. In addition thereto, misalignment of the separating tool such as the chisel can cause cuts or damage to the edges of the blanks which cuts or damage interfere with subsequent processing of the blank into a box or carton.

When die cutting blanks for boxes or cartons in a preprinted sheet, the interconnected blanks in each sheet which are formed by the press operations may be for cartons or boxes for different products even though the size of each of the blanks formed in the sheet may be the same. Thus, since the interconnected blanks in the sheet may be for different products, it is desirable during separation of the blanks that the individual blank from each position in the sheet of interconnected blanks be maintained separately from adjacent blanks to prevent intermixing of blanks which were printed for different products.

A separating and stacking machine which would handle a sheet of interconnected blanks with the blanks arranged in rows is disclosed in U.S. Pat. No. 3,870,213 which was issued on Mar. 11, 1975. In this machine, the sheet of interconnected blanks is carried by an input conveyor to a separating unit which separates the interconnected blanks into individual blanks to create a flow of space side-by-side rows of spaced blanks which are received by a stacking unit having a conveyor system of sets of rollers and upper lower castors. One pair of rollers and castors of each set is designated so that the point of engagement of the upper roller or castor can be shifted on the circumference of the lower roller to apply a deflecting force to a blank passing therethrough to cause the blank to be deflected into a storage compartment or stack receiving means. However, this device has some problems and has not proven to be completely satisfactory during operation. For example, the deflecting force caused by the roller arrangement causes the blank to bend partially around the circumference of the lower roller and imparts a curve or bend in the blank. The curve or bend in the blank impairs the dropping of the blank into the stack.

SUMMARY OF THE INVENTION

The present invention is directed to an improved apparatus for separating a plurality of interconnected blanks formed in a sheet and for stacking the separated blanks in a plurality of designated stacks without subjecting the blanks to permanent or strong bending forces. Preferably each of the designated stacks receives only the blanks from a designated position or registry in the sheet of interconnected blanks.

To accomplish this, the apparatus comprises input means for receiving and delivering the sheet of blanks, separating means arranged to receive a sheet from the input means and to separate the blanks into a flow of spaced blanks, means for conveying the separated blanks, and stacking means for depositing the separated blanks in the designated stacks with the improvements comprising said means for conveying the blank having at least one vacuum conveyor unit acting on the upper face of said blanks, said vacuum conveyor unit having a vacuum chamber with openings on a bottom surface thereof and an endless perforated belt traveling around the vacuum chamber with an inner surface of the lower run of the endless perforated belt in contact with the bottom surface of the vacuum chamber, and said means for stacking including at least one pusher acting as means for releasing a blank extending parallel to the vacuum conveyor, and being positioned above means for receiving a pile of blanks, each pusher being moveable to a sloping position across a plane presented by the lower run of the endless perforated belt to alter the trajectory of the blank which is being conveyed on the conveyor in order to direct the blank into said means for receiving a pile of blanks.

Preferably, the means for stacking includes means for moving each pusher between the sloping position and a withdrawn position that enables selective peeling or directing of the blank into a stack.

The stacking means includes a frame and the means for receiving a stack are adjustably mounted on the frame with the conveyor units or suction units and means for releasing adjustably mounted on the frame above the means for receiving a stack. Preferably, the means for releasing are a plurality of members which are mounted adjacent to each of the suction units with at least one member approximately above the position for each of the designated stacks and are interconnected so that they can be simultaneously actuated to simultaneously peel the blanks carried on the belts of the suction units from the belt so that each blank of the row is simultaneously deposited into its respective stack. To aid in facilitating forming the stacks, the stacking means may include a plurality of members arranged to form accumulating chambers which members can be adjusted to provide accumulating chambers of different sizes and different positions. The stack supporting means is preferably mounted on an elevator means to enable lowering the supporting means to facilitate removal of the stacks formed thereon.

DESCRIPTION OF THE PREFERRED EMBODIMENT

Figure 1:
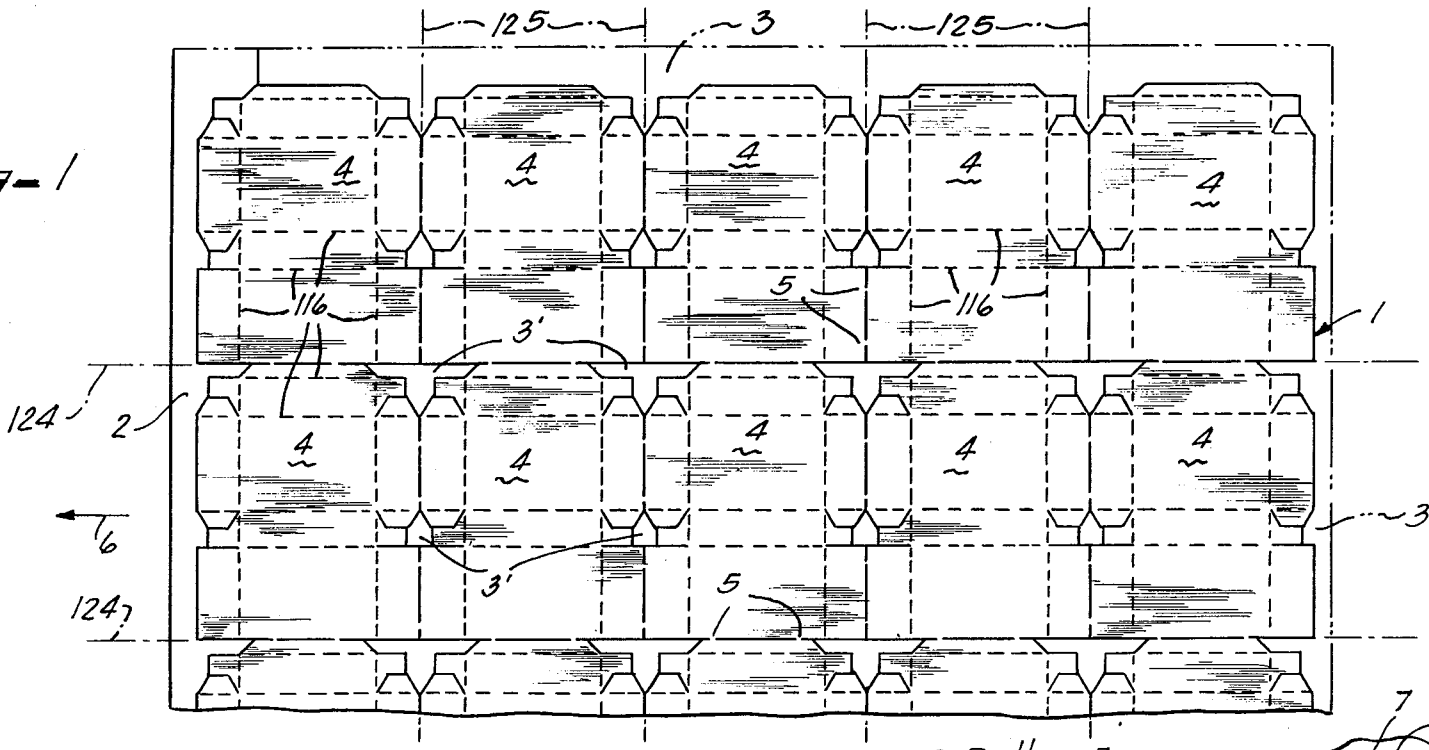
FIG. 1 is a partial plan view of a sheet containing a plurality of interconnected blanks.
Figure 2:
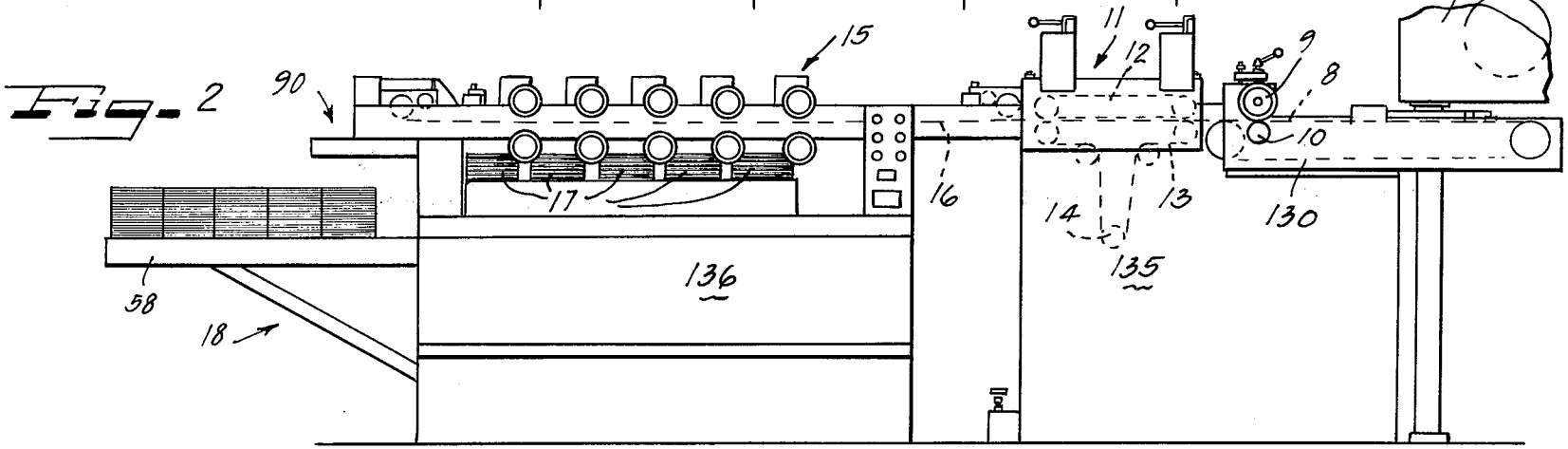
FIG. 2 is a side view with portions remove for purposes of illustration of an embodiment of the apparatus according to the present invention.

The present invention is particularly useful in an apparatus generally indicated at 90 in FIG. 2 for separating a plurality of interconnected blanks 4 formed in a sheet 1 (FIG. 1) and for stacking the separated blanks in designated separate stacks 17. The sheet 1 of interconnected blanks 4 was formed by passing through a platen press 7 (FIG. 2) in a direction indicated by arrow 6 (FIG. 1).

Figure 3:
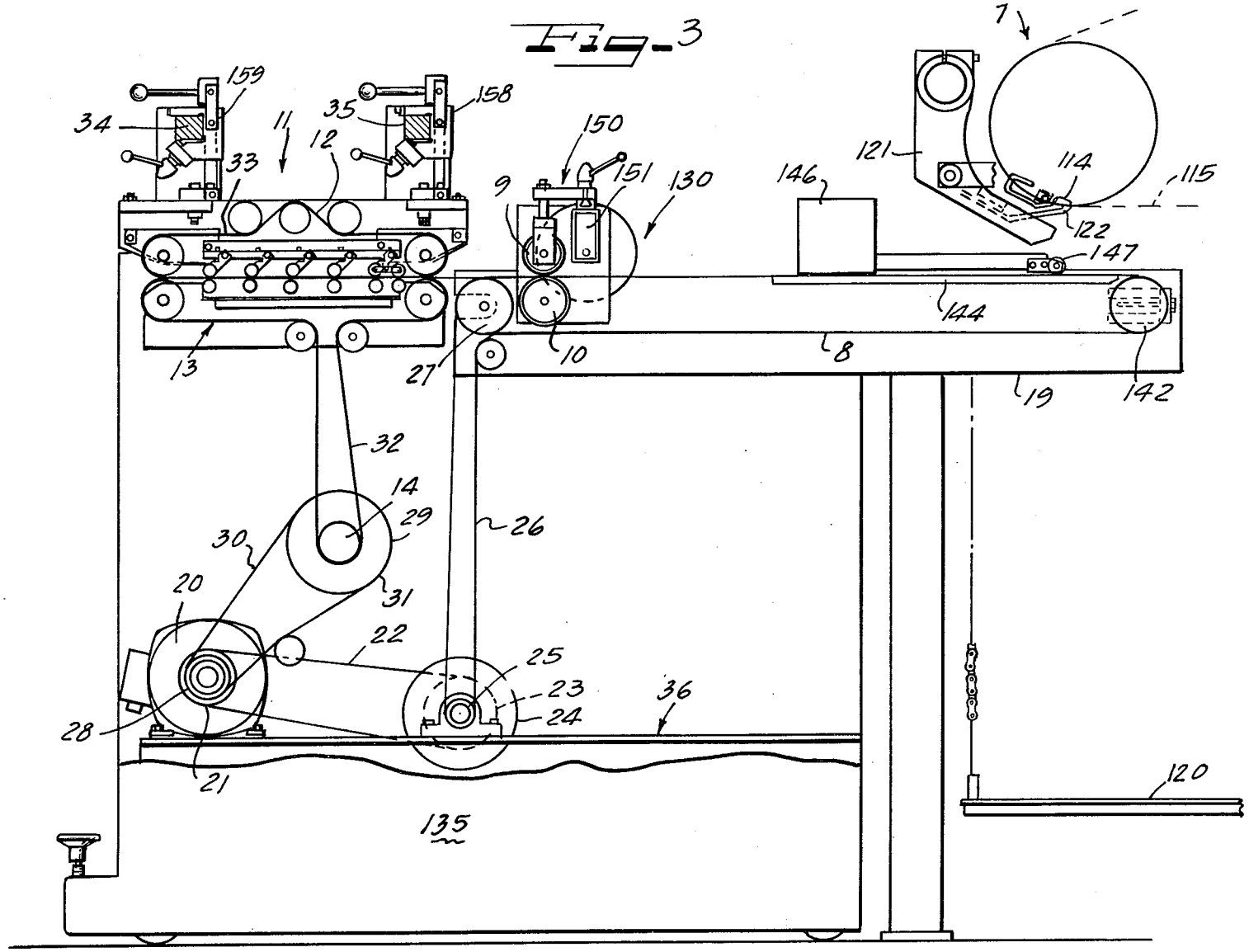
FIG. 3 is an enlarged side view with portions removed and portions in cross section of a portion of the apparatus of the present invention for sidewise and lengthwise separating the blank of the sheet.

The press 7 may be a conventional die cutting and creasing press in which a preprinted sheet of material, such as paste board or heavy paper, is gripped at its leading edge by a gripper bar 114 of an endless chain conveyor 115 and conveyed intermittently through a die cutting and creasing station, a stripping station to a delivery station which is partially illustrated in FIGS. 2 and 3. At the die cutting and creasing station, the preprinted sheet is die cut to form a plurality of interconnected blanks 4 with each of the blanks being provided with creases or fold lines 116 which facilitate subsequent folding of the blank into a carton or box. From the die cutting and creasing station, the conveyor 115 moves the die cut sheet to a stripping station which removes waste portions such as portion 3' between the interconnected blanks 4 and edge waste portions 3. At the stripping station, the only waste portion remaining on the sheet 1 of interconnected blanks 4 is a leading edge portion 2 which is engaged by the gripper bar 114 of the chain conveyor 115 of the press. From the stripping station, the sheet 1 is carried by the conveyor 115 to the delivery station and discharged from the press onto a platform 120 (FIG. 3) which may be raised and lowered relative to the conveyor 115. To release the sheet 1 from the gripper bar 114, a rotatably mounted lever 121 having a plurality of projections or pads 122 is moved to separate the blank 1 from the leading edge portion 2 which is retained in the gripper bar 114 and the sheet 1 separated from the portion 2 is free to fall onto the platform 120 or a stack being formed thereon. After removing the stack formed on the platform 120, blanks 4 were separated manually.

As illustrated in FIG. 1, each of the blanks 4 has been substantially severed from the adjacent blanks except for a few nicks 5 which provide sufficient connections to maintain the blanks 4 in the interconnected sheet 1 for subsequent processing. In the particular sheet 1, the interconnected blanks 4 are interconnected along longitudinally extending connections lines 124 and transverse or laterally extending connecting lines 125. The lines 124 of the sheet 1 effectively define interconnected side-by-side rows of interconnected blanks 4 with each of the blanks 4 in adjacent rows being aligned.

As illustrated in FIG. 2, the apparatus 90 has an input or receiving means 130 which receives a sheet 1 of interconnected blanks 4 and includes a conveyor 8 which transports the sheet 1 to a separating means or unit 11 which separates the individual blanks along the connecting lines 124 and 125 to produce a flow of separated blanks in spaced side-by-side rows of spaced blanks. These blanks are then received in a stacking means or unit 15 which transports the separated blanks to a designated position to overlie their respective designated stacks 17 and then deposit the blanks on these stacks 17.

While individual sheet 1 of interconnected blank 4 could be manually fed into the apparatus 90 from a stack of die cut sheets, preferably, the apparatus 90 is arranged with the input means 130 positioned at the delivery station of a press 7 to receive each sheet discharged therefrom. To facilitate using the apparatus 90 with more than one press 7 and to facilitate movement between different presses, the input means 130 and the separating means 11 are provided in a single portable unit 135 and the stacking means 15 is contained in a separate portable unit 136 which includes a stack removal system or device 18.

As best illustrated in FIG. 3, the unit 135 has a separate frame 36 comprising various frame members and supports motive forces illustrated as an electrical motor 20. The conveyor 8 of the input means 130 comprises a continuous belt whose path is defined by a driven roll 27 and roll 142 which are supported for rotation between a pair of side frame members 19,19 of frame 36. The roll 142 defines an input or lead end of the conveyor and the roll 27 denotes the discharge end. A back-up or support plate 144 is mounted in the frame adjacent to the input roll 142. The motor 20 has a pulley 21 which is connected by a belt 22 to an input pulley 23 of a variator 24. The variator 24 has an output pulley 25 which is connected by a belt 26 to a pulley on the driven roll 27. To ensure the receiving of a sheet 1 on the conveyor 8 as the sheet is released from press 7, a sheet engaging means 146 may be positioned on the frame 36. An example of this means is disclosed in a co-pending U.S. application Ser. No. 612,571 filed Sept. 11, 1975, by Paul Scheck (Our Case No. 75,584 based on Swiss Application No. 013250/74 filed Oct. 2, 1974). The means 146 has a roller 147 which is reciprocated along the belt of conveyor 8 to engage a leading edge portion of the sheet deposited on the belt and presses this portion against the belt so that sheet will be carried on the belt.

Adjacent the driven roll 27, a plurality of pressure applying means 150 are adjustably mounted on a transverse frame member 151 whose position along the direction of movement of the conveyor 8 can be adjusted as desired. Each pressure applying means 150 includes a pressure roll or member 9 which as illustrated coacts with a lower pressure roll or back-up roll 10 to apply a gripping pressure on a portion of a sheet being conveyed by the conveyor 8 therethrough.

The separating means 11 is mounted on the frame 36 to receive a sheet discharged from the input or conveyor means 8. The separating means includes a plurality of coacting upper conveyors 12 and lower conveyor 13 which are arranged fan-wise. Each of the upper conveyors 12 is provided with a forward and rear mounting means 158 and 159 with the front mounting means 158 being adjustably positioned on a transverse frame member 35 and the rear mounting means 159 being adjustably positioned on a transverse frame member 34. The lower conveyors 13 are also adjustably mounted in the frame 36.

The motor 20 also drives the conveyors 12 and 13 and has a pulley 28 transmitting motion by a belt 30 to a pulley 31 of a variator 29. An output shaft of the variator 29 has a pulley 14 for each of the lower conveyors 13 which each have a belt 32 driven by the pulley 14. The upper conveyors 12 have belts 33 which are in contact with the respective belt 32 which frictionally drives the belt 33. Both the belts 32 and 33 are substantially narrow belts and each pair of conveyors 12 and 13 act as a separating belt unit.

Due to different output speed of the variators 24 and 29, the belts 32 and 33 of each of the conveyors 12 and 13 are moving at a faster rate of speed than the belt of conveyor.8 of the input or delivery means. Thus, as the sheet 1 of interconnected blanks 4 passes through the pressure means 150 and is inserted between the upper and lower belts 33 and 32 of the separating means 11, the difference in the conveying speed of the separating means 11 and the input means 130 creates a pulling force on the sheet as the leading group or row of transversely extending blanks is received in the separating means and the following transverse row is gripped by the pressure means 150. This pulling force causes separation along each transverse connecting line 125 as the connecting line passes in the space between the output of the pressure means 150 and the inlet end of the separating means 11.

If the sheet 1 contained a single row of interconnected blanks, a single separating belt unit could be utilized. However, since the majority of the sheets to be treated in the apparatus 90 of the present invention would have two or more rows of interconnected blanks 4, the separating belt units are arranged in the frame with a single belt unit aligned to engage the blanks 4 of each row. By properly adjusting the rear mounting means 159 with respect to the forward mounting means 158, the belt units are arranged to provide a fan-like path or slightly diverging path between adjacent side-by-side rows so that a lateral separating force is applied between the transversely disposed blanks to cause separation along the connection line 124. Thus, the separating means 11 produces a flow of blanks arranged in spaced side-by-side rows of spaced blanks which flow is substantially the same as the relationship of the blanks 4 when interconnected in the sheet 1.

The portable unit 136 (FIG. 4) has a frame 91 which supports the stacking means 15 and the stack or pile removal device 18. Adjacent an inlet end of the stacking means 15, the frame 91 has an inlet or receiving plate 92 to receive a flow of blanks 4 discharged from the exit end of the separating means 11 which is schematically illustrated by the ends of the conveyors 12 and 13.

The stacking means 15 includes a conveyor means for conveying or transporting the blanks received on the plate 92. The conveyor means is formed by at least one vacuum or suction conveyor unit 46 for each row of blanks 4 which are being received by the stacking means 15. Each vacuum or suction conveyor unit 46 includes an elongated suction or vacuum chamber 37 which is provided with a pair of end housings or plates 42 and 43 which include means for adjustably attaching the vacuum conveyor unit to transverse members 44 and 45 of the frame of the unit 136.

Figure 6:
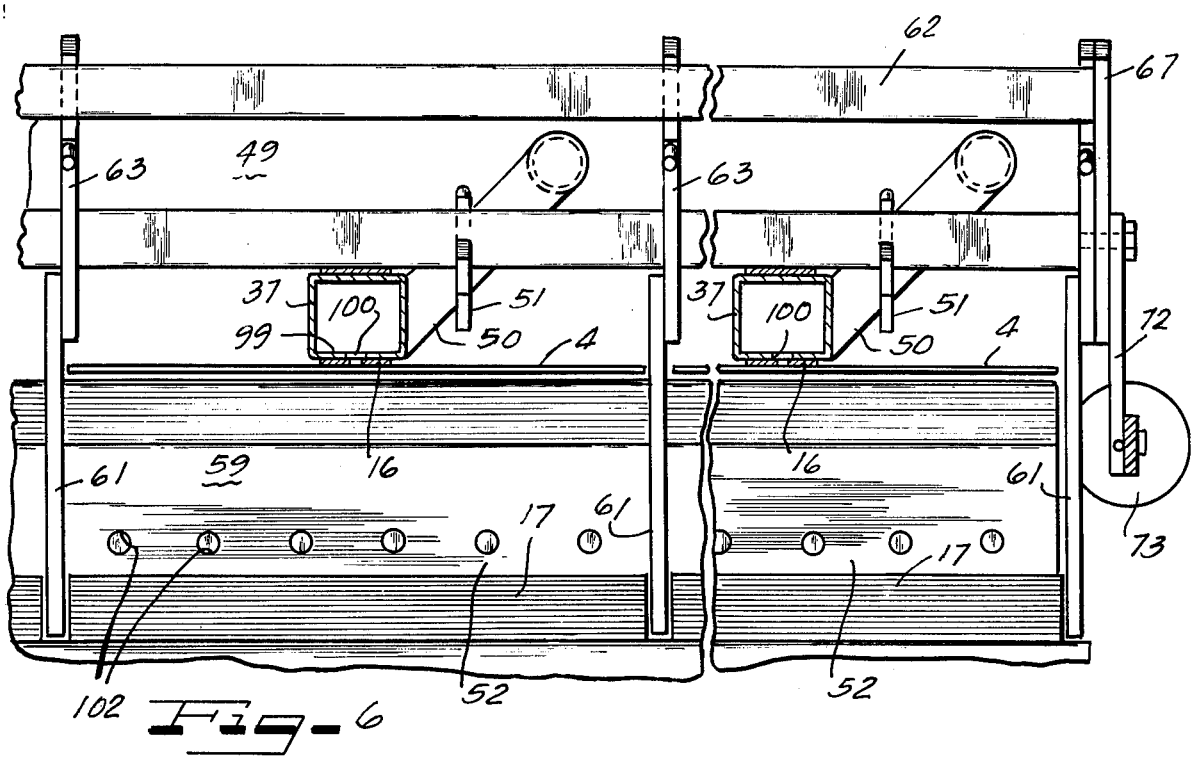
FIG. 6 is a partial cross-sectional view taken on lines VI—VI of FIG. 5.

As best illustrated in FIG. 6, each of the chambers 37 on one side 99 which is a lower surface is provided with means defining an elongated port 100 which means can be either a single elongated slot or a plurality of slots or apertures arranged to provide the elongated port. To convey a blank 4 along the chamber 37, each of the vacuum conveyor units 46 includes an endless belt 16 of pervious material which is illustrated as a flexible belt having apertures aligned with the ports 100. The endless belt 16 (FIG. 4) is supported on a pair of rolls 38 and 41 with a portion such as a lower run engaging the one surface 99. The rolls or pulleys 38 and 41 along with idler rolls or pulleys 39 and 40 are mounted for rotation in the housing or plates 42 and 43. To drive or transport the belt, one of the end rolls such as roll 38 is a driven roll and can be adjustably mounted on a drive shaft which is connected to a source of rotation (not illustrated). As mentioned above, the number of rows of blanks in the sheet 1 and the position of each unit 46 on the cross members 44 and 45 is adjusted to contact a row of blanks.

To supply each of the chambers 37 of the vacuum conveyors 46 with a suction or vacuum, each chamber is connected by an appropriate conduit or flexible hose 50 to a manifold 49. The manifold 49 is connected by a conduit or flexible hose 48 to a source of suction or a vacuum source 47 which source is illustrated as a blower with the conduit 48 being connected to the intake port thereof.

When a blank 4 is received on plate 92, the belt 16 of a vacuum or suction conveyor 46 will engage an upper surface of the blank and grip the blank with a suction. The blank held by the suction on the belt 10 is transported along the vacuum chamber 37 to a position above the designated stack 17 which stack is contained in a stack receiving means or an accumulating chamber 52. To cause a depositing of the blank into its designated stack 17, a pusher 51 is mounted between each of the conveyors 46 and adjacent thereto and can assume a position 52' (FIG. 5) which has a surface sloping across the plane of the blank 4 being transported on the belt 16 to cause the trajectory of the blank to be changed. With the change of the trajectory, the blank 4 is peeled from the belt 16 and is deposited in the accumulating chamber or means 52 for receiving the stack 17.

A portion of each of the accumulating chambers 52 is formed by a stack descent device generally indicated at 55 which includes a plurality of parallel spaced rollers 53 mounted between longitudinal beams 54. The upper surfaces of the rollers 53 form an effective lower surface 93 of each of the chambers 52. The descent device 55 includes elevator means 94 which shifts the effective support surface 93 from the position illustrated in FIG. 4 to the lower position 56 illustrated in broken lines. When in the lower position 56, rotary movement of the transverse rollers 53 will move the piles or stacks 17 in the direction of arrow 57 onto a roller table 58 which forms a portion of the stack removal device 18. It should be noted that the elevator structure 94 can be a conventional structure having a drive structure connected to an electric motor and which drive structure will gradually lower the effective surface 93 as the height of the stack 17 deposited thereon increases.

Figure 5:
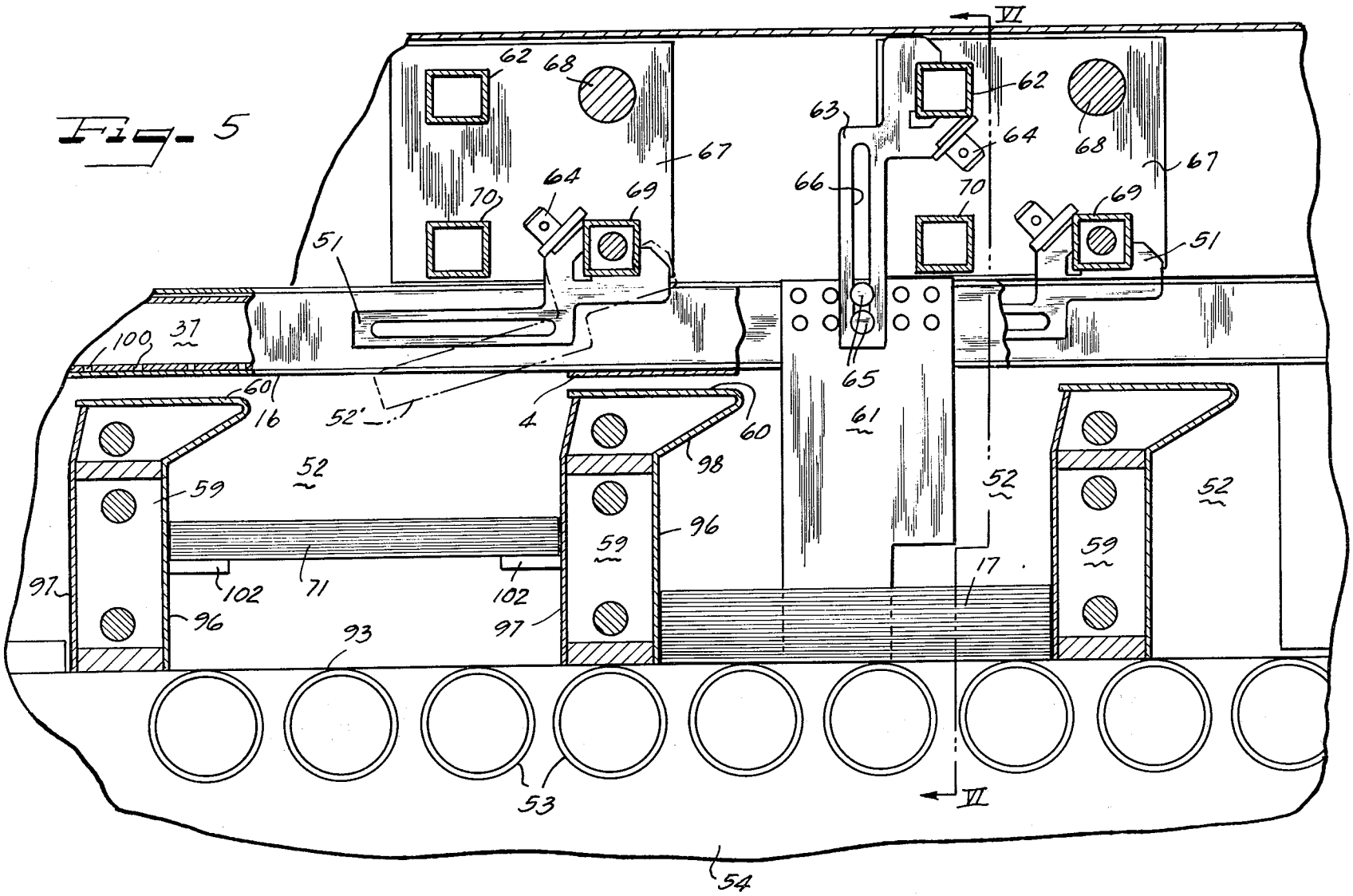
FIG. 5 is an enlarged view with portions broken away illustrating the peeling means and the chambers for accumulating the blanks of the present apparatus.

As best illustrated in FIG. 5, each of the accumulating chambers 52 has spaced transversely extending side members 59 which are adjustably mounted on the frame 91. Each of the members 59 has an upper surface 60, a pair of spaced walls 96 and 97 and a deflecting surface 98 extending from between the upper surface 60 and the side wall 96. Thus, the walls 96 and 98 of each transverse member 59 forms one wall for engaging a leading edge of the blank 4 being deposited in the stack 17 while the wall 97 guides the rear edge. The formation of each accumulating chamber 52 is completed by a pair of side wall members 61 with each side wall member 61 attached to a support 63 which is adjustably mounted on a crossbar 62. To adjust the dimensions of the chambers 52, the support 63 can be shifted axially on the crossbar 62 and held in the desired position by a tightening or clamping device 64 (FIG. 5). The side wall 61 is attached to the support 63 by screws 65 which are received in an elongated slot 66 so that the vertical position of the side wall 61 can be adjusted.

The cross member 62 extends between and is rigidly connected to a pair of flanges 67 which flanges also support a beam 68 and a pair of pivoting crossbars 69 and 70. The subassembly formed by the flanges 67 and the crossbars or members 62, 68, 69 and 70 can be shifted along the length of the suction conveyor unit 46 to a desired position for the stack. The side members such as 59 will be shifted simultaneously based on the size and position of the blanks 4 to be received in the accumulating chambers 52 with the shifting on the frame of the stacking means 15 being by appropriate well-known means.

The pushing members 51 are adjustably mounted on one of the pivoting crossbars 69 and 70 so their position can be adjusted along the axis thereof. As illustrated in FIG. 5, the pushing member 51 has the same configuration as the support 63 and includes a clamping device 64 for fixing the pusher 51 on the pivoting crossbar such as 69 (FIG. 5) or 70 (FIG. 6).

As best illustrated in FIG. 6, each of the pivoting crossbars 69 and 70 is connected by a lever arm or linkage 72 to the ram of a pneumatic cylinder 73 so that actuation of the cylinder causes the pusher members or deflecting members 51 to shift to the position 52' to cause peeling of the blanks such as 4 from the belt 16. Preferably, the ram of the cylinder 73 is interconnected to each of the pivoting cross members 70 and 69 so that all of the pusher or peeling elements 51 are actuated simultaneously.

Each of the members 59 may be provided with a plurality of retractable fingers or gates 102 (FIGS. 5 and 6) which extend out of the walls 96 and 97 to form a catching surface for a pile of blanks 71 which is spaced above the effective surface 93. Thus, with the fingers 102 extended as shown in the left hand side of FIG. 5, the blanks 4 will be formed in the piles 71 and the previously formed pile resting on the rollers 53 can be removed by the descent device 55 being shifted to position 56 to transfer the piles onto the roller table 58.

Figure 4:
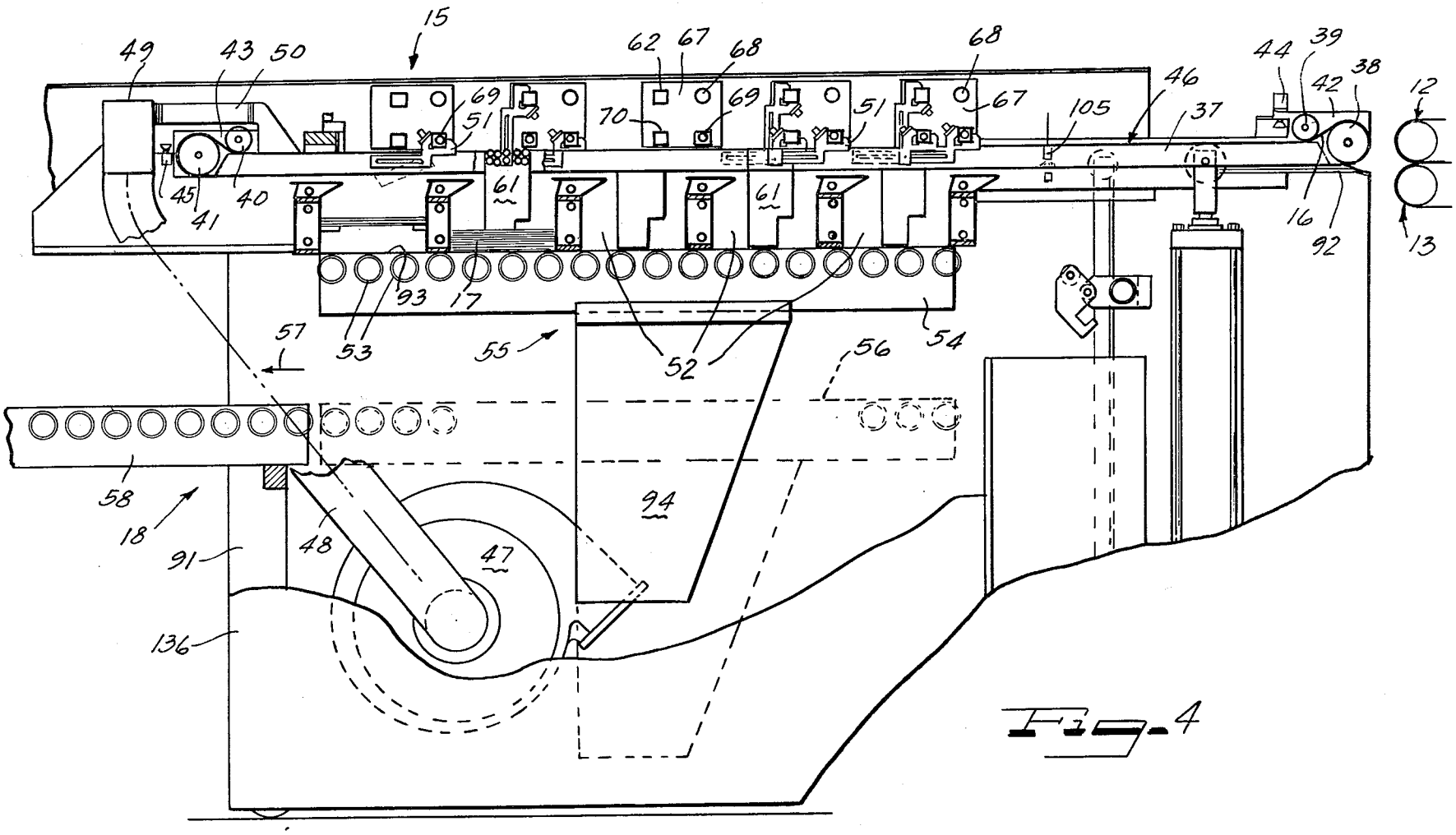
FIG. 4 is a side view of a portion of the apparatus for stacking the separated blanks according to the present invention with portions broken away for purposes of illustration.

The device 90 as illustrated in FIG. 2 receives a sheet 1 of interconnected blanks 4 which blanks are separated both longitudinally and transversely from adjacent blanks to produce a flow of blanks in rows having spaced blanks in each row. The blanks are sequentially transferred to the stacking means 15 by having the adjacent blank of each row being transferred to the plate 92 where the belts 16 of the suction conveyors 46 engages the top surface to transport the blanks along the vacuum or suction chambers 37. As illustrated in FIG. 4, the device is arranged for five blanks in each row and as the blanks approach the designated accumulation chamber 52, the pusher or peeling members 51 are shifted to position 52' to cause peeling of the blank into the chamber. In order to sense the passage of the required number of blanks, sensing means such as a photo-electric sensing device 105 will be positioned to determine that all the blanks are approaching the desired chamber and actuate the pneumatic cylinder 73 to shift the members 51 to the peeling position. The operation of the sensing device is described in the above-mentioned U.S. Pat. No. 3,870,213.

As the piles 17 obtain the desired height which can be higher than the height of each of the accumulating chambers 52 due to the lowering of the effective surface 93 by the elevator device 94, the gates or members 102 can be extended so that subsequent blanks are deposited in the piles 71. With the members 102 extended, the piles 17 can be removed without interrupting the continuous operation of the apparatus 90. After the removal of the piles 17 from the rollers 53, and after returning the rollers to the position illustrated in FIG. 4, the fingers 102 can be withdrawn back into the members 59 to release the stacks 71 to fall on the effective surface 93 of the rollers for formation of a second group of stacks 17.

Figure 7:
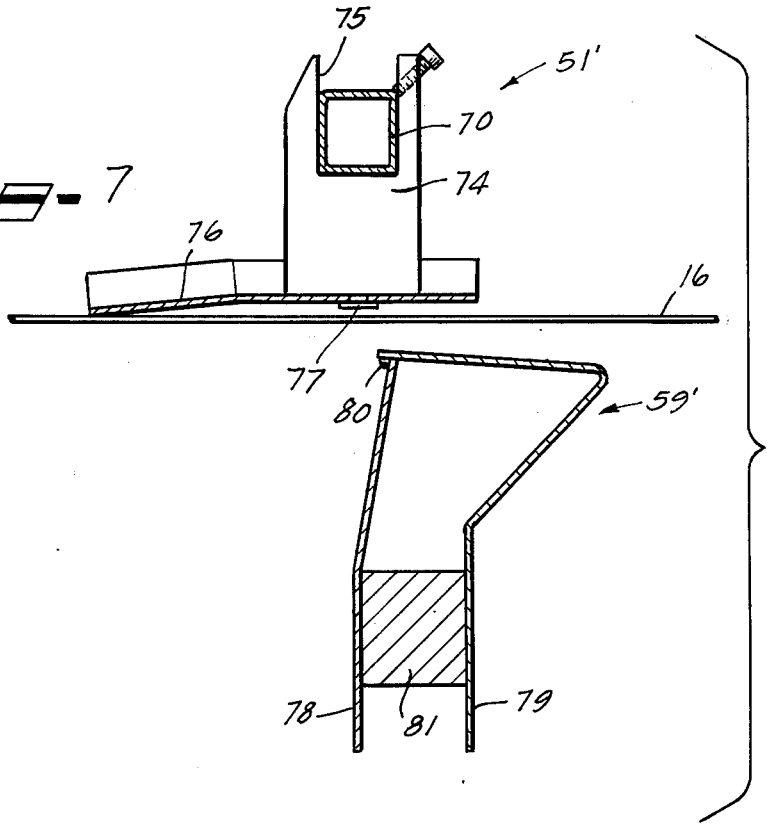
FIG. 7 illustrates an embodiment of the peeling means of the present invention.

An embodiment of the pusher or peeling element is illustrated in FIG. 7 and is generally indicated at 51'. The pusher 51' is formed of a block 74 which has a slot 75 for receiving a pivotable cross member such as 70. The end of the block 74 opposite the slot 75 is provided with an arm 76 which is a U-shaped channel member having a sufficient width to be received on the block 74 and is held on the block 74 by a fastening means such as a screw 77. As illustrated, the channel member 76 may have a slightly sloping portion adjacent its free end.

An embodiment of one of the transverse members is generally indicated at 59', and is constructed of a pair of steel plates 78 and 79 which are welded together at 80 and fitted onto a square cross member 81 by means not illustrated. Each of the sheets 78 and 79 is provided with appropriate bends to provide the desired sloping surfaces similar to the deflection surface 98 of the embodiment of the member 59 illustrated in FIG. 5.

The embodiment of the pusher 51' has the particular advantage of being able to peel a blank from the belt 16 without damaging the blank and the embodiment of the transverse member 59' has an advantage of ensuring easy and reliable piling up of the blank in the particular accumulation chamber.

Although various minor modifications might be suggested by those versed in the art, it should be understood that I wish to employ within the scope of the patent granted hereon, all such modifications as reasonably and properly come within the scope of my contribution to the art.

I claim:

1. An apparatus for separating a plurality of interconnected blanks formed in at least one row in a sheet and for stacking the separated blanks in a plurality of designated stacks, comprising an input means for receiving the sheet with each row of blanks extending parallel to the direction of movement of the sheet in the input means, separating means arranged to receive a sheet from the input means and to separate the blanks into a flow of spaced blanks with the blanks of each row moving in a path one after another, and stacking means for depositing the separate blanks in designated stacks including a frame, means mounted on the frame for supporting each of the designated stacks and including means for receiving a separate designated stack for each of the blanks in a row of the sheet, suction means for each row of blanks mounted on the frame above the support means for engaging an upper surface of each of the blanks of the row and transporting each of the engaged blanks to a position above the means for receiving for its designated stack on the support means, and means for releasing the blank from the suction means to cause the depositing of each blank onto its designated stack, said means for releasing comprising a peeling member mounted for pivotable movement at each of said designated stacks, and means for simultaneously pivoting each of the peeling members from a first position withdrawn from the path of a blank being transported on the suction means and a second position extending across the path of the blank at an angle so that all of the blanks are simultaneously peeled from the suction means and deposited into their respective stacks.

2. An apparatus according to claim 1, wherein the number and position of each of the suction means is adjustable to enable handling a flow having a different number of side-by-side rows of separated blanks.

3. An apparatus according to claim 1, wherein the number and the position of each of the peeling members is adjustable to enable stacking of blanks separated from a sheet having different size blanks and number of blanks in each of the side-by-side rows.

4. An apparatus according to claim 1, wherein the means for receiving comprises accumulating chambers defined by a plurality of transverse and longitudinally extending member adjustably mounted on the frame so that the number and size of the chambers can be adjusted for different numbers and sizes of blanks in a sheet.

5. An apparatus according to claim 4, wherein each of the accumulating chambers is provided with gate means which are moveable from a position extending into the accumulating chamber to catch the blanks deposited therein to a position removed from the accumulating chamber to allow passage of blanks therethrough onto the stack supporting means and wherein the stack supporting means is mounted in the frame by elevator means enabling movement of the stack supporting means from adjacent the accumulating chamber to a lower position enabling removal of the designated stacks therefrom so that during removal of the stacks from the lowered supporting means, the apparatus can continue to operate.

6. An apparatus according to claim 1, wherein each of the suction means and each of the peeling members are adjustably mounted in the frame to enable changing the number of suction means and their respective positions to correspond to the number of rows of interconnected blanks in each of the sheets being separated and stacked and to enable adjusting the number and the position of the peeling members associated with each of the suction means to match the number and size of blanks in each row of the sheet of interconnected blanks.

7. An apparatus according to claim 1, wherein the stack supporting means is mounted on the frame by means enabling lowering of the supporting means to facilitate removal of the stacks of blanks formed during operation of the apparatus.

8. An apparatus according to claim 1, wherein each suction means including an elongated chamber having means forming an elongated port on one side thereof, said chamber being connected to means providing a suction and extending from the inlet end over each of the means for receiving for a row of blanks with the port facing the stack supporting means, a continuous belt of pervious material engaging said one side to cover the port and means for moving the belt along said side.

9. An apparatus according to claim 1, wherein each peeling member for a row of blanks is mounted on a separate rotatable shaft, and where the means for simultaneously pivoting simultaneously rotates all of the shafts.

* * * * *